US012098875B2

(12) United States Patent
Voltarelli et al.

(10) Patent No.: US 12,098,875 B2
(45) Date of Patent: Sep. 24, 2024

(54) VARIABLE CLIMATE ZONE WIRING

(71) Applicant: Electrolux Do Brasil S.A., Curitiba (BR)

(72) Inventors: Antonio Voltarelli, Curitiba (BR); Marcelo Campani, Curitiba (BR); Israel Mercer, Curitiba (BR); Rafael Leidens, Curitiba (BR); Alcione Colecha, Curitiba (BR); Guilherme Picanço, Curitiba (BR)

(73) Assignee: Electrolux do Brasil S. A., Curitiba (BR)

( * ) Notice: Subject to any disclaimer, the term of this patent is extended or adjusted under 35 U.S.C. 154(b) by 1058 days.

(21) Appl. No.: 16/976,534

(22) PCT Filed: Mar. 2, 2018

(86) PCT No.: PCT/BR2018/050054

§ 371 (c)(1),
(2) Date: Aug. 28, 2020

(87) PCT Pub. No.: WO2019/165522

PCT Pub. Date: Sep. 6, 2019

(65) Prior Publication Data

US 2021/0003337 A1 Jan. 7, 2021

(51) Int. Cl.
*F25D 11/02* (2006.01)
*F25D 25/02* (2006.01)

(52) U.S. Cl.
CPC ..... *F25D 11/022* (2013.01); *F25D 25/025* (2013.01); *A47B 2210/0048* (2013.01);
(Continued)

(58) Field of Classification Search
CPC ..... F25D 11/02; F25D 11/022; F25D 25/025; F25D 2323/021; F25D 2400/40;
(Continued)

(56) References Cited

U.S. PATENT DOCUMENTS 5,248,196 A 9/1993 Ynn et al.
D625,343 S 10/2010 Seo et al.
(Continued)

OTHER PUBLICATIONS

International Search Report and Written Opinion for International Application No. PCT/BR2018/050052, dated Jan. 22, 2019, 17 pages.

(Continued)

*Primary Examiner* — Joseph F Trpisovsky
(74) *Attorney, Agent, or Firm* — Pearne & Gordon LLP

(57) ABSTRACT

Provided is a refrigeration appliance including a main electrical board that controls operation of the refrigeration appliance and an adjustable temperature compartment for storing food items at a user-selectable target temperature. The adjustable temperature compartment includes a user interface connected to the main electrical board by an electric wire cable and enabling selection of user-selectable target temperature. A first end of the electric wire cable includes a removable connector connected to the user interface. The second end of the electric wire cable is connected to the main electrical board. A method for manufacturing a refrigeration appliance with an adjustable temperature compartment is also provided.

15 Claims, 11 Drawing Sheets

(52) U.S. Cl.
CPC ..... *A47B 2210/175* (2013.01); *F25C 2400/10* (2013.01); *F25D 2323/021* (2013.01); *F25D 2400/40* (2013.01)

(58) Field of Classification Search
CPC ..... A47B 2210/0048; A47B 2210/175; F25C 2400/10
See application file for complete search history.

(56) References Cited

U.S. PATENT DOCUMENTS

| | | | |
|---|---|---|---|
| D714,361 | S | 9/2014 | Seo et al. |
| 9,046,295 | B2 | 6/2015 | Han et al. |
| 9,115,929 | B2 | 8/2015 | Han et al. |
| 9,217,601 | B2 | 12/2015 | Koo et al. |
| 9,335,086 | B2 | 5/2016 | Koo et al. |
| 9,523,531 | B2 | 12/2016 | Han et al. |
| 9,585,474 | B2 | 3/2017 | Haltmeyer et al. |
| 2005/0236947 | A1 | 10/2005 | LeClear et al. |
| 2010/0162747 | A1 | 7/2010 | Hamel et al. |
| 2011/0146333 | A1 | 6/2011 | Koo et al. |
| 2011/0181163 | A1 | 7/2011 | Han et al. |
| 2015/0022072 | A1 | 1/2015 | Haltmeyer et al. |
| 2015/0323243 | A1 | 11/2015 | Han et al. |
| 2017/0160000 | A1 | 6/2017 | Haltmeyer et al. |
| 2017/0167779 | A1* | 6/2017 | Haeberle ..... F25D 25/025 |
| 2018/0180349 | A1 | 6/2018 | Han et al. |

OTHER PUBLICATIONS

Samsung RF28JBEDBSG 4-door French Door Refrigerator Review, reviewed 2017, retrieved form the internet Aug. 17, 2020, https://www.reviewed.com/refrigerators/content/samsung-rf28jbedbsg-4-door-french-door-refrigerator-review, 9 pages.

* cited by examiner

VARIABLE CLIMATE ZONE WIRING

This application is a U.S. National Phase application of PCT International Application No. PCT/BR2018/050054, filed Mar. 2, 2018, which is incorporated by reference herein.

CROSS-REFERENCE TO RELATED APPLICATIONS

Not Applicable.

FIELD OF THE INVENTION

This application relates generally to a variable climate zone compartment for a refrigeration appliance, and more particularly, to a refrigeration appliance including an adjustable temperature drawer that is located in a variable climate zone compartment between the fresh food compartment and the freezer compartment, together with the electrical wiring of the adjustable temperature drawer.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases, the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Recently, to accommodate the consumer varying preferences for additional storage space with a desired storing temperature, an adjustable temperature drawer or a Variable Climate Zone ("VCZ") compartment may be arranged separate from, such as between, the fresh food compartment and the freezer compartment. Such an adjustable temperature drawer can be used either as a refrigerator storage space or as a freezer according to the user's selection of the desired temperature on a user interface provided at an accessible location by the user portion of the VCZ compartment and connected to a main electrical board that controls the operation of the refrigeration appliance.

Power to and communication between the main electrical board of the refrigeration appliance and the user interface of the VCZ compartment is provided via electric wire cables. It is desirable that these electric wire cables are free to bend within the VCZ compartment and the freezer compartment, are secured in a desired position, and are protected from damage or interference while the drawer moves between an extended position and a retracted position.

BRIEF SUMMARY OF THE INVENTION

In accordance with one aspect, there is provided a refrigeration appliance including a main electrical board configured to control operation of the refrigeration appliance, a fresh food compartment for storing food items at a first target temperature above zero degrees Centigrade, a freezer compartment for storing food items at a second target temperature below zero degrees Centigrade, and an adjustable temperature compartment for storing food items at a user-selectable target temperature. The adjustable temperature compartment includes a user interface connected to the main electrical board by an electric wire cable and configured to enable selection of user-selectable target temperature, a door closing the adjustable temperature compartment from the exterior environment, a support structure attached to a wall within the adjustable temperature compartment, and a storage bin supported by the support structure and movable with respect to the support structure, the storage bin having a frame supporting the storage bin. A first end of the electric wire cable includes a removable connector connected to the user interface. The second end of the electric wire cable is connected to the main electrical board.

In the refrigeration appliance according to the foregoing aspect, the user interface may be provided at a surface of the adjustable temperature compartment that is not visible when the adjustable temperature compartment is in a closed position.

In the refrigeration appliance according to the foregoing aspect, the user interface may be provided on an upper portion of the door of the adjustable temperature compartment.

In the refrigeration appliance according to the foregoing aspect, the user interface is accessible when the door of the adjustable temperature compartment is extended from the refrigeration appliance.

In the refrigeration appliance according to the foregoing aspect, the electric wire cable may be secured to the frame of the storage bin via ties or straps.

In the refrigeration appliance according to the foregoing aspect, the adjustable temperature compartment may be arranged between the fresh food compartment and the freezer compartment.

In the refrigeration appliance according to the foregoing aspect, a liner may define the fresh food compartment, the freezer compartment, and the adjustable temperature compartment, and a slot may be formed through a side wall of the liner, such that the electric wire cable enters the adjustable temperature compartment through the slot.

In the refrigeration appliance according to the foregoing aspect, a portion of the electric wire cable between the ties or straps and the slot is free to move, without restraint, when the storage bin is inserted into and removed from the adjustable temperature compartment.

In the refrigeration appliance according to the foregoing aspect, the support structure may include a frame mounted to an inner surface of the side wall of the liner. The frame may be positioned above the slot such that no portion of the frame covers the slot.

In the refrigeration appliance according to the foregoing aspect, a removable partition may separate the adjustable temperature compartment and the freezer compartment. A portion of the electric wire cable exiting the slot may extend in an open space bounded by a lower surface of the frame, an upper surface of the removable partition, and the side wall.

In the refrigeration appliance according to the foregoing aspect, a portion of the electric wire cable is seated underneath the removable partition.

In the refrigeration appliance according to the foregoing aspect, the frame includes opposite side legs and a connecting bar. The electric wire cable passes through a space formed between the storage bin and one of the opposite side legs of the frame.

In the refrigeration appliance according to the foregoing aspect, the frame may include a slide assembly with timing bar pinion gears attached to both sides of the frame and a plurality of gear teeth forming linear gear tracks for engaging the timing bar pinion gears. The electric wire cable may pass through a space formed between the storage bin and the plurality of gear teeth.

In the refrigeration appliance according to the foregoing aspect, the liner comprises an enclosure in fluid communication with the slot, the enclosure being arranged between the liner and an outer shell of the refrigerator. The enclosure defines a space to receive at least a portion of electric wire cable and the enclosure is configured to avoid entry of foam during an insulation foaming injection operation to inject foam between the liner and an outer shell of the refrigerator.

In the refrigeration appliance according to the foregoing aspect, the enclosure compromises a cover installed in a covering relationship to seal an exterior main opening of the enclosure against foam entry and to secure the electric wire cable therein.

In accordance with another aspect, there is provided a method for manufacturing a refrigeration appliance. The method includes providing an enclosure at an outer surface of a liner. The method further includes arranging an electric wire cable inside the enclosure. The electric wire cable includes a first end connected to a main electrical board that controls operation of the refrigeration appliance, and a second end with a connector attached at the second end. The method also includes inserting an insulating foam into a void space between the enclosure and the outer surface of the liner to define an adjustable temperature compartment. The method further includes, after inserting the insulating foam, removing the electric wire cable from the enclosure and penetrating the wire into the adjustable temperature compartment via a through hole. The method also includes connecting the connector at the second end of the electric wire cable to a mating connector of a user interface that enables selection of said user-selectable target temperature of the adjustable temperature compartment.

In the method for manufacturing a refrigeration appliance according to the foregoing aspect, the method further includes sealing the enclosure against foam entry so that no foam penetrates into the enclosure and the adjustable temperature compartment.

In the method for manufacturing a refrigeration appliance according to the foregoing aspect, the method further includes providing the liner with the through hole and providing the enclosure in a position aligning with the through hole.

In the method for manufacturing a refrigeration appliance according to the foregoing aspect, wherein providing an enclosure at an outer surface of a liner includes providing the enclosure and attaching the enclosure to the outer surface of the liner.

In the method for manufacturing a refrigeration appliance according to the foregoing aspect, the method further includes inserting an insulating foam into a void space between the enclosure and the outer surface of the liner to define a fresh food compartment for storing food items at a first target temperature above zero degrees Centigrade and a freezer compartment for storing food items at a second target temperature below zero degrees Centigrade.

In the method for manufacturing a refrigeration appliance according to the foregoing aspect, the method further includes forming an open box on an interior wall of a door of the adjustable temperature compartment and placing the connector at the second end of the electric wire cable inside the open box and securing the connector at the second end of the electric wire cable in a position to the open box.

DESCRIPTION OF EXAMPLE EMBODIMENTS

Figure 1:
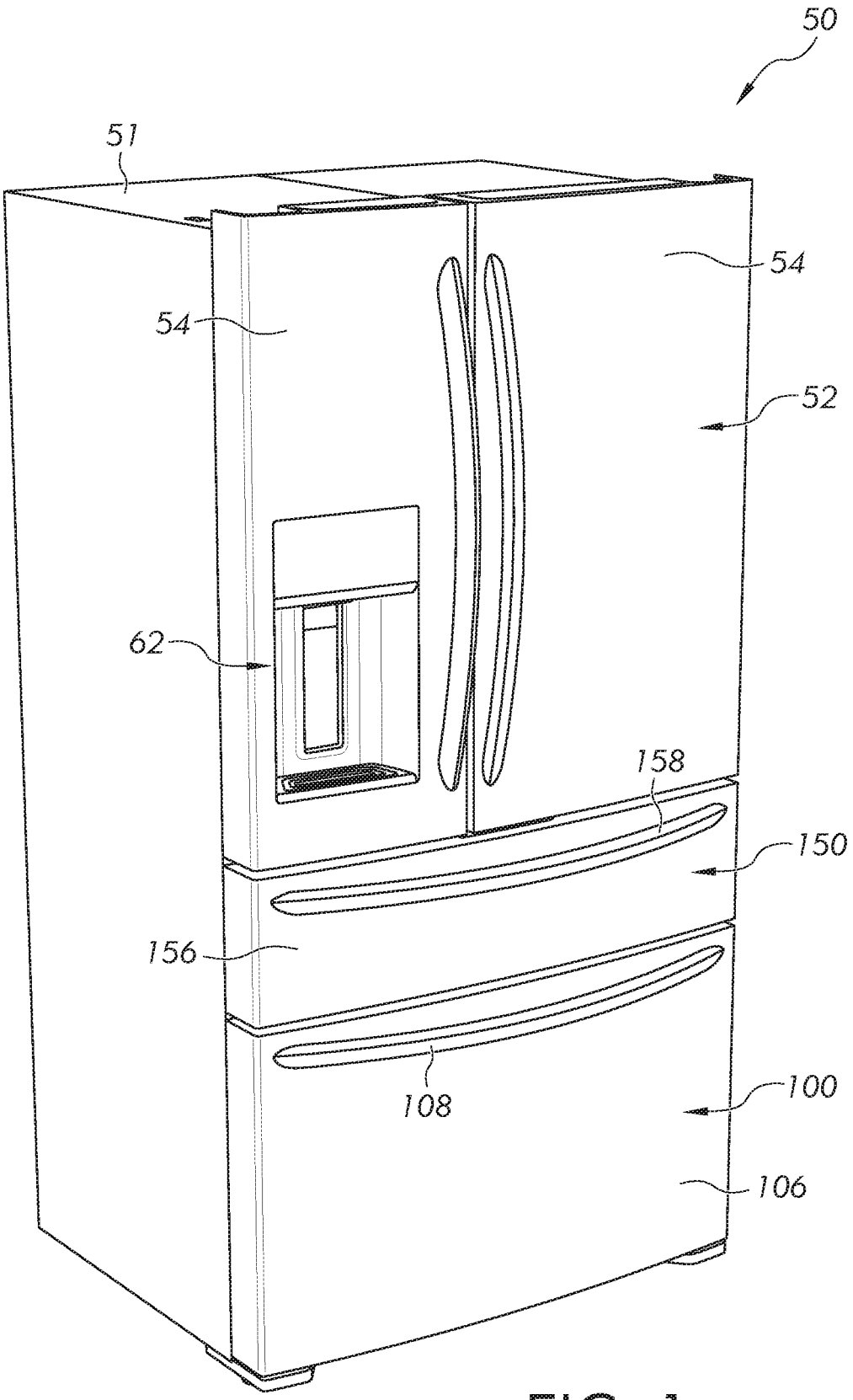
FIG. 1 is a front perspective view of a household French Door Bottom Mount refrigerator showing doors of the refrigerator in a closed position.

Apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein.

Referring now to the drawings, FIG. 1 shows a refrigeration appliance in the form of a domestic refrigerator, indicated generally at 50. Although the detailed description that follows concerns a domestic refrigerator 50, the invention can be embodied by refrigeration appliances other than with a domestic refrigerator 50. Further, an embodiment is described in detail below, and shown in the figures as a bottom-mount configuration of a refrigerator 50, including a fresh food compartment 52 disposed vertically above a variable climate zone (VCZ) compartment 150 and a freezer compartment 100.

Two doors 54 shown in FIG. 1 are pivotally coupled to a cabinet 51 of the refrigerator 50 to restrict and grant access to the fresh food compartment 52. The doors 54 are French-type doors that collectively span the entire lateral distance of the entrance to the fresh food compartment 52 to enclose the fresh food compartment 52. A center flip mullion 58 (FIG. 2) is pivotally coupled to at least one of the doors 54 to establish a surface against which a seal provided to the other one of the doors 54 can seal the entrance to the fresh food compartment 52 at a location between opposing side surfaces 56 (FIG. 2) of the doors 54. The mullion 58 can be pivotally coupled to the door 54 to pivot between a first orientation that is substantially parallel to a planar surface of the door 54 when the door 54 is closed, and a different orientation when the door 54 is opened. The externally-exposed surface of the center mullion 58 is substantially parallel to the door 54 when the center mullion 58 is in the first orientation, and forms an angle other than parallel relative to the door 54 when the center mullion 58 is in the second orientation. In the embodiment shown in FIG. 1, the seal and the externally-exposed surface of the mullion 58 cooperate at a position offset from a centerline midway between the lateral sides of the fresh food compartment 52. It is contemplated that the seal and the externally-exposed surface of the mullion 58 can cooperate approximately midway between the lateral sides of the fresh food compartment 52.

Turning back to FIG. 1, a dispenser 62 for dispensing at least ice pieces, and optionally water, can be provided on an exterior of one of the doors 54 that restricts access to the fresh food compartment 52. The dispenser 62 includes a lever, switch, proximity sensor or other device that a user can interact with to cause frozen ice pieces to be dispensed from an ice bin (not shown) of an ice maker 64 disposed within the fresh food compartment 52. Ice pieces from the ice maker 64 can exit the ice maker 64 through an aperture (not shown) and be delivered to the dispenser 62 via an ice chute (not shown), which extends at least partially through the door 54 between the dispenser 62 and the ice maker.

Figure 2:
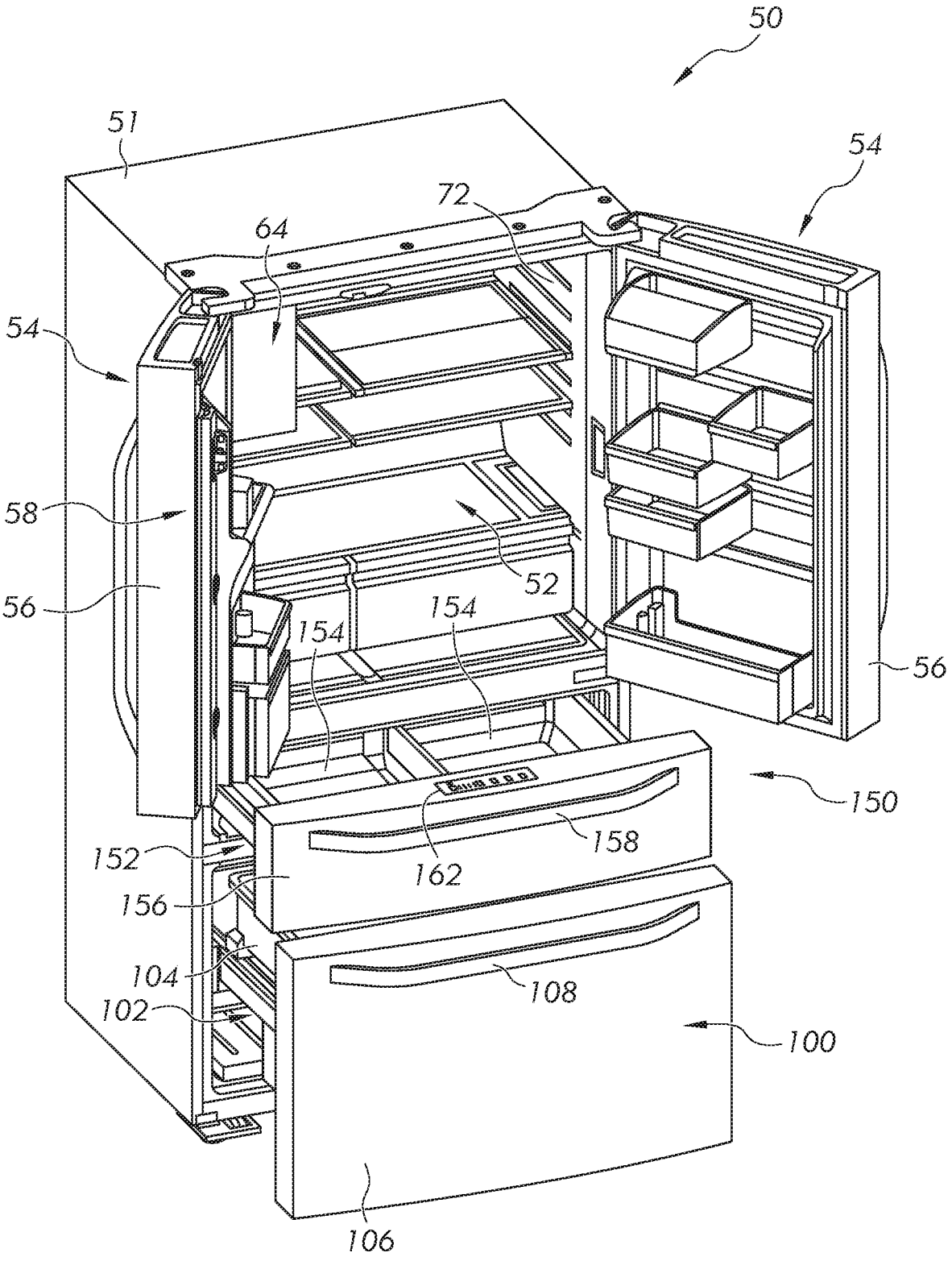
FIG. 2 is a front perspective view of the refrigerator of FIG. 1 showing doors of a fresh food compartment and drawers of a freezer compartment and a variable climate zone compartment in an opened position.
Figure 3A:
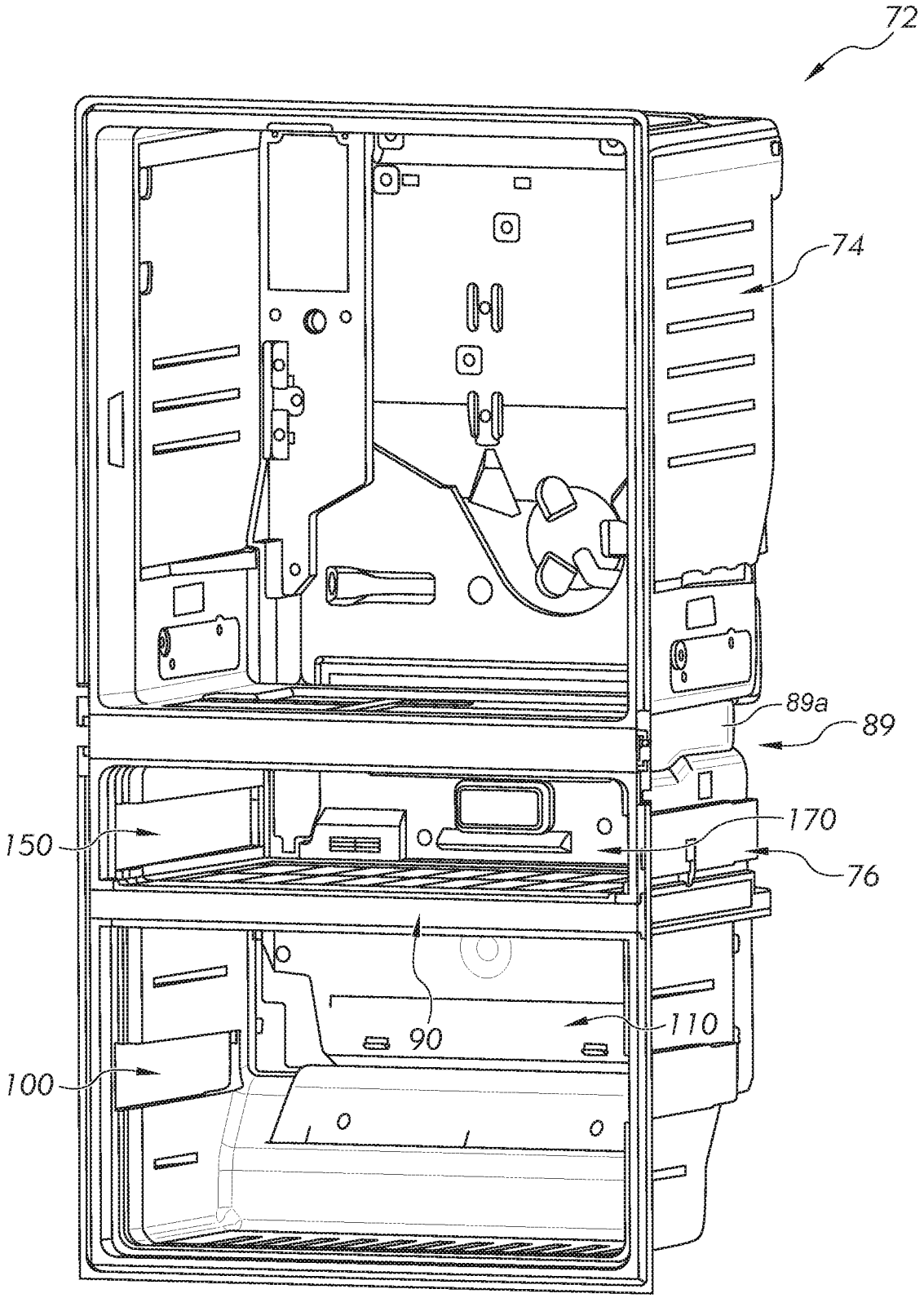
FIG. 3A is a front perspective view showing a liner of the refrigerator of FIG. 1 for the fresh food compartment, the freezer compartment and the variable climate zone compartment, and a portion of a foamed insulation between an upper compartment and a lower compartment of the liner, according to an embodiment.

Referring to FIG. 2 and FIG. 3A, the refrigerator 50 includes an interior liner 72 formed to define an upper compartment 74 and a lower compartment 76. It is contemplated that the space 89 between the upper compartment 74 and the lower compartment 76 may be filled with an expanding blown foam material 89*a*. The foam material 89*a* is configured to aid in thermally isolating the upper compartment 74 and the lower compartment 76, as well as providing structural support for the refrigerator 50 once cured.

The upper compartment 74 defines the fresh food compartment 52 which serves to minimize spoiling of articles of food stored therein. The fresh food compartment 52 accomplishes this by maintaining the temperature in the fresh food compartment 52 at a cool temperature that is typically above 0° C., so as not to freeze the articles of food in the fresh food compartment 52. It is contemplated that the cool temperature preferably is between 0° C. and 10° C., more preferably between 0° C. and 5° C., and even more preferably between 0.25° C. and 4.5° C. A fresh food evaporator (not shown) is dedicated to separately maintaining the temperature within the fresh food compartment 52 independent of the freezer compartment 100. According to an embodiment, the temperature in the fresh food compartment 52 can be maintained at a cool temperature within a close tolerance of a range between 0° C. and 4.5° C., including any subranges and any individual temperatures falling with that range. For example, other embodiments can optionally maintain the cool temperature within the fresh food compartment 52 within a reasonably close tolerance of a temperature between 0.25° C. and 4° C.

The upper compartment 74 and the lower compartment 76 of the liner 72 are configured such that the air circulated in the upper compartment 74 is maintained separated from the air circulated in the lower compartment 76. The lower compartment 76 defines the freezer compartment 100 and the VCZ compartment 150. In this respect, the air circulated in the fresh food compartment 52 is maintained separated from the air circulated in the VCZ compartment 150 and the freezer compartment 100.

Figure 3B:
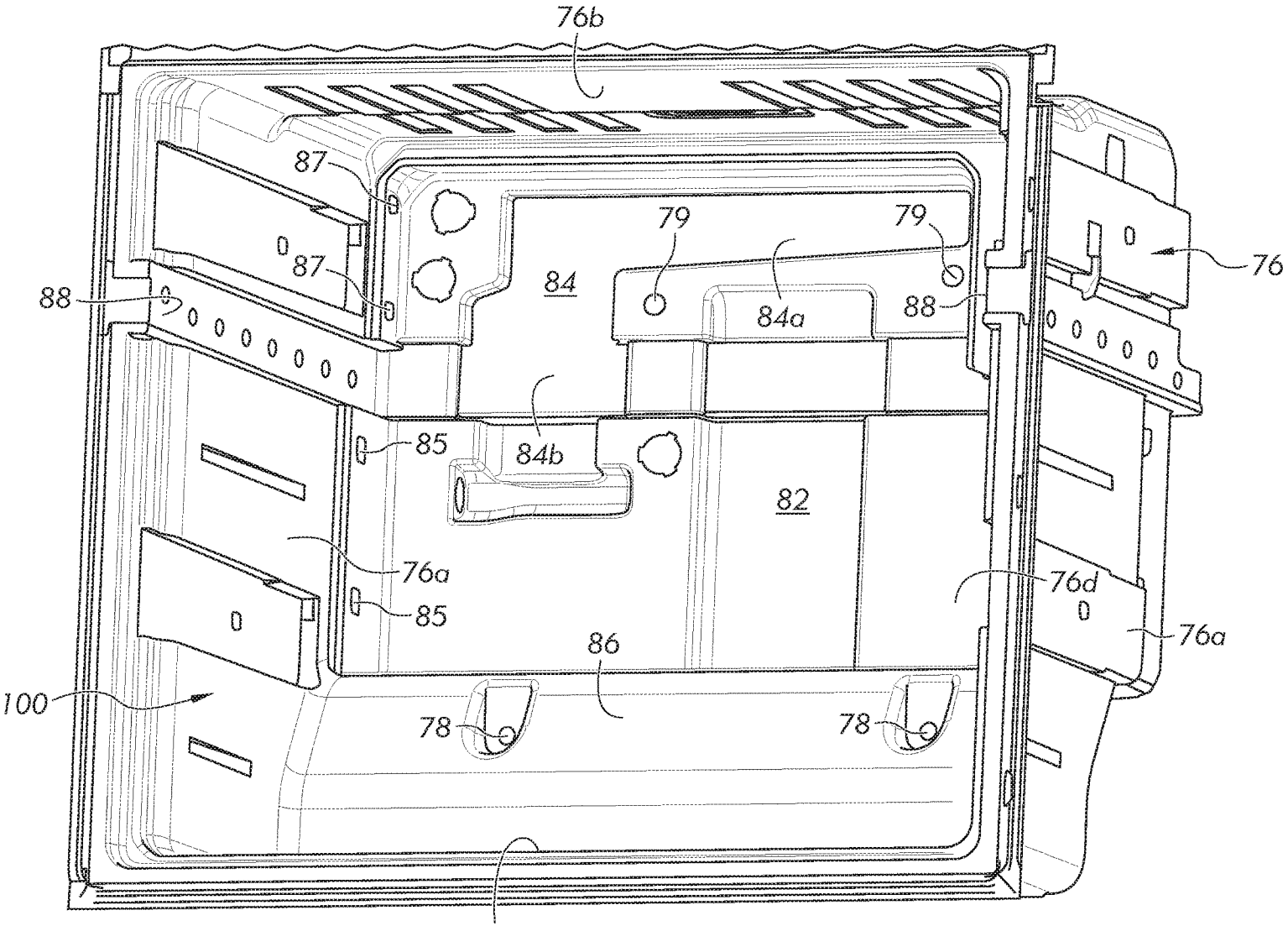
FIG. 3B is a partial front perspective view showing a lower compartment of the liner of FIG. 3A.

Referring to FIG. 3B, the lower compartment 76 includes side walls 76*a*, a top wall 76*b*, a bottom wall 76*c*, and a rear wall 76*d*. A plurality of lower recesses 85 is formed in a lower portion of the side walls 76*a* near the rear wall 76*d* and a plurality of upper recesses 87 is formed in an upper portion of the side walls 76*a* side walls near the rear wall 76*d*. The rear wall 76*d* is contoured to define a first recess 82 and a second recess 84. The first recess 82 is shown to be generally rectangular in shape and extending in a vertical direction. The second recess 84 is shown to be generally L-shaped with a generally horizontal portion 84*a* and a generally vertical portion 84*b*. The bottom wall 76*c* includes a generally sloped portion 86. A plurality of upper mounting holes 79 extend through the rear wall 76*d* below generally horizontal portion 84*a*. The plurality of upper mounting holes 79 are positioned and dimensioned as described in detail below. A plurality of lower mounting holes 78 extend through an upper portion of the sloped portion 86. A horizontal recess 88 is formed in the side walls 76*a* for receiving a partition 90.

Figure 4A:
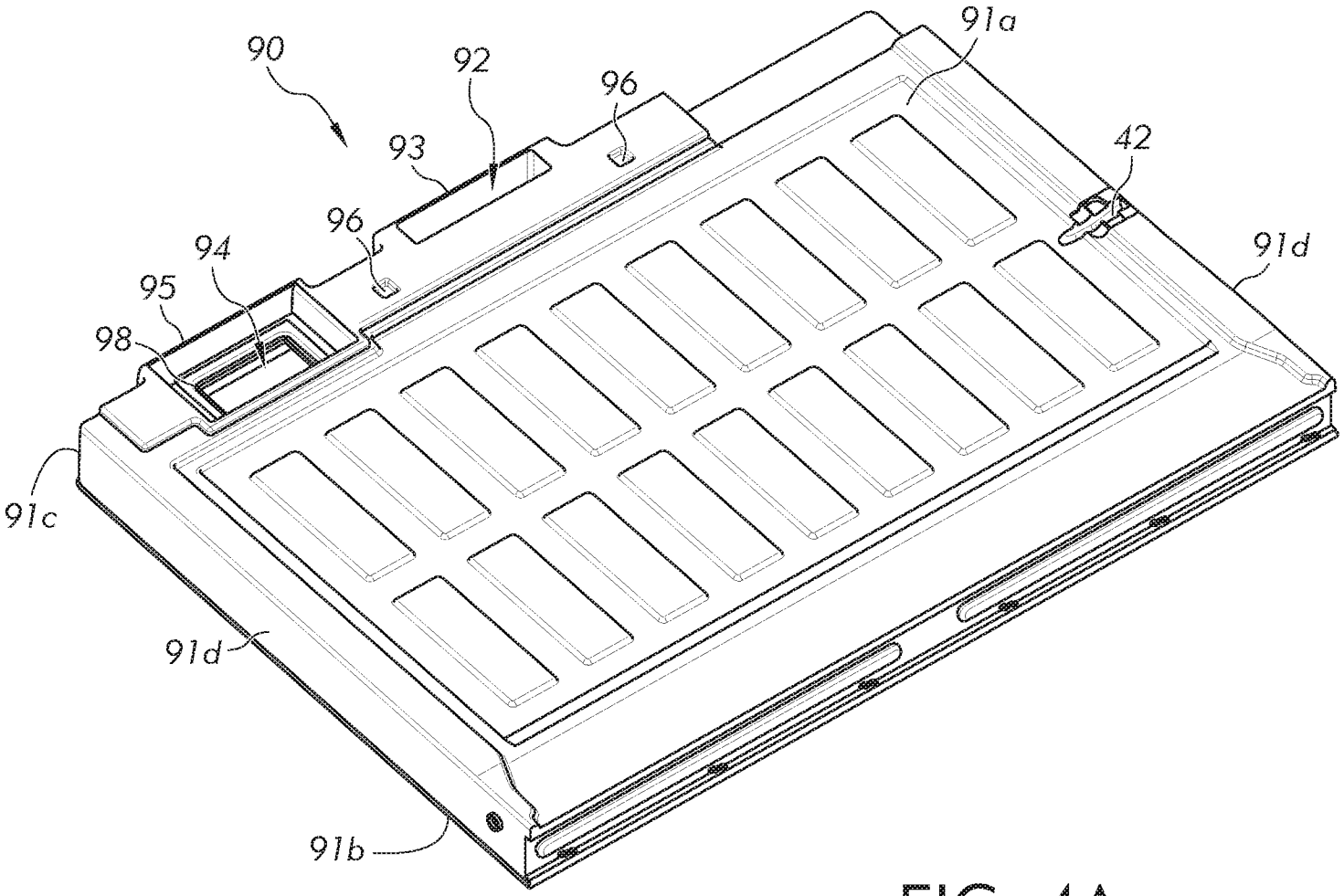
FIG. 4A is a top perspective view of a partition for separating the freezer compartment from the variable climate zone compartment of FIG. 3A, according to an embodiment.

Turning back to FIG. 3A, the partition 90 is disposed in the lower compartment 76 for separating the lower compartment 76 into the freezer compartment 100 and the VCZ compartment 150. Referring to FIG. 4A, the partition 90 includes a first opening 92 and a second opening 94 extending between an upper surface 91*a* and a lower surface 91*b* of the partition. The openings 92, 94 allow fluid to flow through the partition 90 and establish fluid communication between the freezer compartment 100 and the VCZ compartment 150. The first opening 92 and the second opening 94 are shown as elongated rectangular openings. It is contemplated that the first opening 92 and the second opening 94 may have other shapes, e.g., circular, oval, square, etc. A seat 98 may be formed in the second opening 94. As shown, the seat 98 extends inwardly about a periphery of the second opening 94. It is contemplated that the seat 98 may be a continuous ledge that extends about the second opening 94, a plurality of segmented ledges or discrete ledges at one or more corners or sides of the second opening 94.

The partition 90 includes a rear wall 91*c* and a side walls 91*d*. The rear wall 91*c* is contoured to match the contour of the rear wall 76*d* of the lower compartment 76. As shown, the rear wall 91*c* of the partition 90 includes a first protrusion 93 and a second protrusion 95. The first opening 92 aligns with the first protrusion 93 and the second opening 94 aligns with the second protrusion 95. It is contemplated that the first opening 92 may at least partially extend through the first protrusion 93 and the second opening 94 may at least partially extend through the second protrusion 95. A plurality of recesses 96 is formed in the upper surface 91*a* of the partition 90 near the rear wall 91*c*. As shown, one recess 96 is disposed to one side of the first opening 92 and another recess 96 is disposed to an opposite side of the first opening 92.

It is contemplated that the partition 90 may be a "not foamed" element. The term "not foamed" is used herein to mean that the partition 90 may not be permanently attached to the liner 72. Conventional partition walls or mullion walls in refrigerators are foamed insulations that cannot be removed, i.e., the partition wall or the mullion wall is a permanent structural wall of the refrigerator. It is contemplated that the partition 90 may be a "not foamed" element and may be removed, if desired, so that the freezer compartment 100 occupies the entire lower compartment 76, without the presence of the VCZ compartment 150. However, it is to be appreciated that the interior of the partition 90 may still include an insulating material of various types, including an insulating foam material, so as to help maintain the desired temperatures of the freezer compartment 100 and the VCZ compartment 150.

Figure 4B:
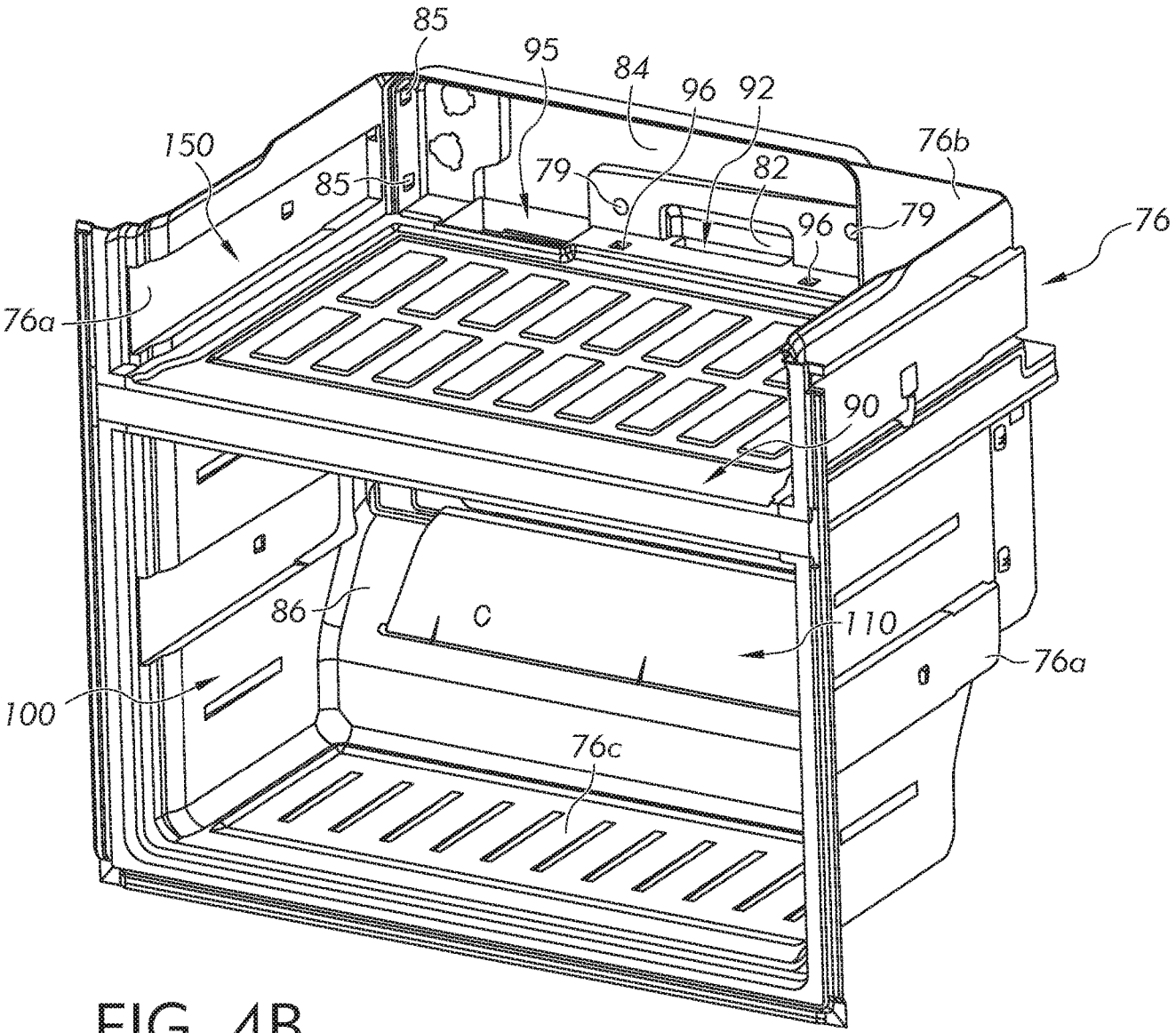
FIG. 4B is a front perspective view of the lower compartment of FIG. 3A with a top wall of the lower compartment removed showing the partition of FIG. 4A.

Referring to FIG. 4B, the partition 90 is dimensioned to be received in the lower compartment 76. In FIG. 4B, the partition 90 is shown fully inserted into the lower compartment 76. The partition 90 is positioned in the lower compartment 76 such that the first protrusion 93 of the partition 90 is received into the first recess 82 in the rear wall 76*d* of the lower compartment 76 and the second protrusion 95 of the partition 90 is received into the second recess 84 in the rear wall 76*d*. A seal member (not shown) may be disposed between the rear wall 91*c* and the rear wall 76*d* for defining a seal between the partition 90 and the rear wall 76*d* of the lower compartment 76. The side walls 91*d* (FIG. 4A) of the partition 90 are received into the horizontal recess 88 (FIG. 3B) formed in the side walls 76*a* of the lower compartment 76. It is also contemplated that seal members (not shown) may be disposed between the side walls 91*d* of the partition 90 and the side walls 76*a* of the lower compartment 76 for defining a seal between the partition 90 and the side walls 76*a* of the lower compartment 76. Once the partition 90 is fully inserted into the lower compartment 76, fluid communication between the freezer compartment 100 and the VCZ compartment 150 may be established through the first opening 92 and the second opening 94.

Referring again to FIG. 2, the freezer compartment 100 is arranged vertically beneath the VCZ compartment 150. A drawer assembly 102 including one or more freezer baskets 104 can be withdrawn from the freezer compartment 100 to grant a user access to food items stored in the freezer compartment 100. The drawer assembly 102 can be coupled to a freezer door 106 that includes a handle 108. When a user grasps the handle 108 and pulls the freezer door 106 open, at least one or more of the freezer baskets 104 is caused to be at least partially withdrawn from the freezer compartment 100.

The freezer compartment 100 is used to freeze and/or maintain articles of food stored in the freezer compartment 100 in a frozen condition. For this purpose, the freezer compartment 100 is in thermal communication with a freezer evaporator (not shown) that removes thermal energy from the freezer compartment 100 to maintain the temperature therein at a temperature of 0° C. or less during operation of the refrigerator 50, preferably between 0° C. and −50° C., more preferably between 0° C. and −30° C. and even more preferably between 0° C. and −20° C. The freezer compartment 100 is also in communication with the VCZ compartment 150 such that a portion of the cooling air supplied by the freezer cooling module 110 may be selectively supplied to the VCZ compartment 150.

Referring again to FIG. 2, the VCZ compartment 150 is arranged vertically beneath the fresh food compartment 52 and is positioned in the lower compartment 76 above the partition 90. The VCZ compartment 150 is configured to operate at different user-selectable temperatures as either a refrigerator (i.e., above-freezing) or a freezer (i.e., below-freezing). In general, the VCZ compartment 150 includes a drawer assembly 152 (shown in FIG. 2) and a temperature control system 170 (shown in FIG. 3A).

The drawer assembly 152 is positioned in the VCZ compartment 150 and includes a basket or tray 154 for storing food items thereon. The drawer assembly 152 can be withdrawn from the VCZ compartment 150 to grant a user access to the food items stored therein. The drawer assembly 152 includes a door 156 having a handle 158 attached thereto. When a user grasps the handle 158 and pulls the door 156, the basket or tray 154 is caused to be at least partially withdrawn from the VCZ compartment 150.

A control unit or user interface 162 is disposed on an upper portion of the door 156. The user interface 162 is positioned such that it is not visible when both the drawer assembly 152 of the VCZ compartment 150 and the drawer assembly 102 of the freezer compartment 100 are in the closed position (see FIG. 1). The user interface 162 is accessible when the door 156 of the VCZ compartment 150 is extended from the refrigerator. The user interface 162 is configured to allow a user the ability to selectively operate the VCZ compartment 150 at one of a variety of temperatures including both true fresh food and freezing temperatures, for example, −18° C., −12° C., −2 C, 0° C. and +4° C. It is contemplated that the user interface 162 may be a plurality of push buttons, a touch display screen, a keyboard or any conventional device for allowing a user to input commands to a control system (not shown) of the refrigerator 50.

Figure 5A:
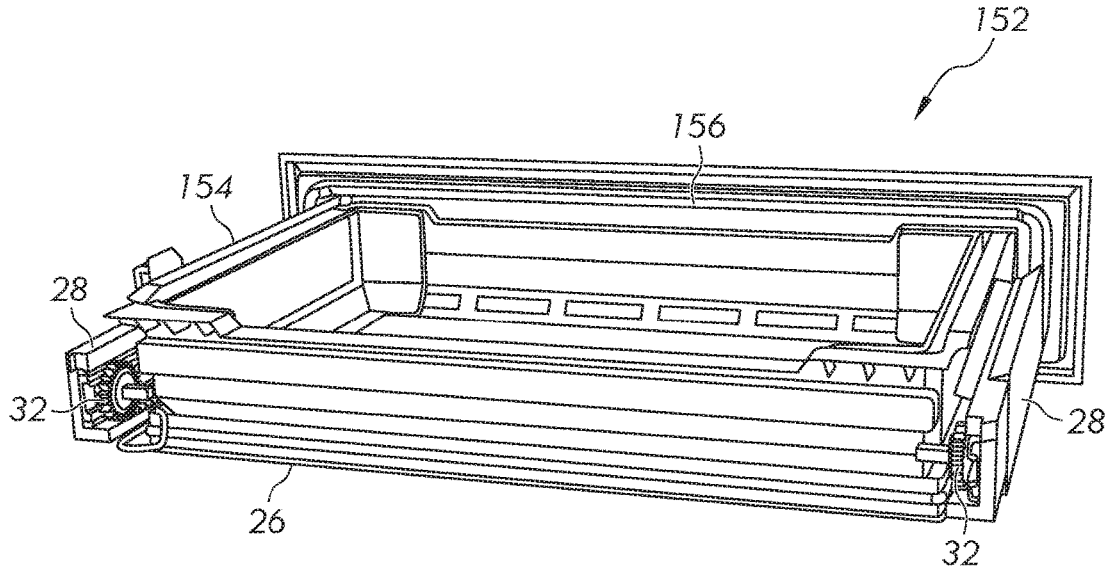
FIG. 5A is a rear view of the adjustable temperature drawer assembly with the liner removed for clarity, according to an embodiment.

FIG. 5A is a rear view of the drawer assembly 152 of the VCZ compartment 150 with the liner 72 removed for clarity. The drawer assembly 152 includes a basket or tray 154, a door 156, and a frame 26 for supporting the basket or tray 154. A slide assembly 28 is attached to both sides of the frame 26. The slide assembly 28 allows the drawer assembly 152 of the VCZ compartment 150 to move between a retracted position and an extended position. In one example, the slide assembly 28 can be a pair of linear slides or ball-bearing slides that telescopically extend and retract. A pair of pinion gears 32 is connected by a shaft as part of a timing bar system and rides along linear gear tracks to inhibit the drawer assembly 152 from "racking" or being moved at an angle when the drawer assembly 152 is moved between the foregoing positions.

Figure 5B:
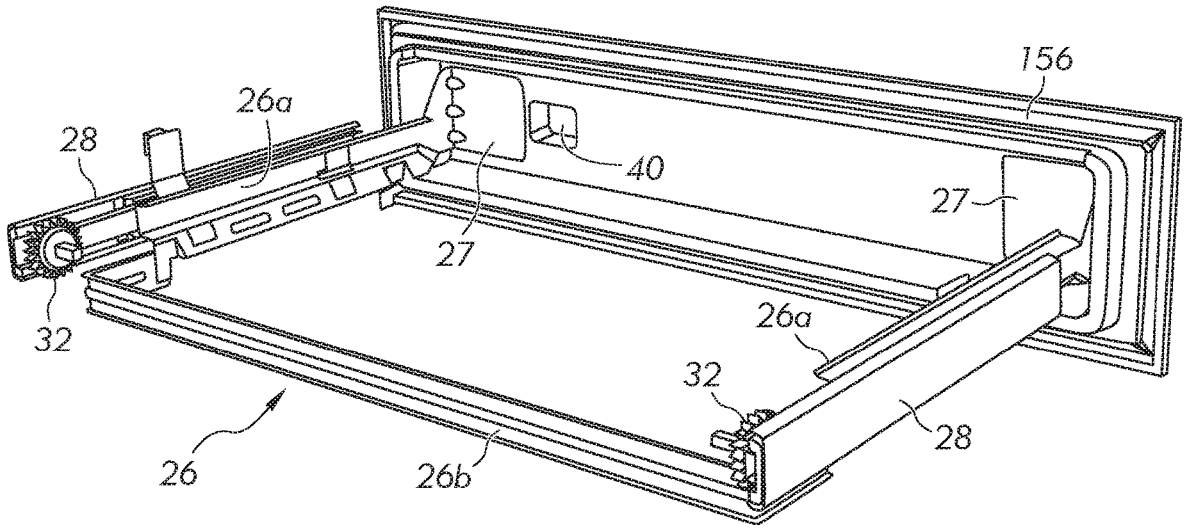
FIG. 5B is a rear view of the adjustable temperature drawer assembly with the storage bin removed for clarity, according to an embodiment.

FIG. 5B shows the drawer assembly 152 with the basket or tray 154 removed for clarity. The frame 26 includes opposite side legs 26*a* each attached to an interior side of an associated slide assembly 28, and a connecting bar 26*b* extending between the opposite side legs 26*a*. Each side leg 26*a* includes a front mount 27 that is secured to an interior face of the door 156 to thereby attach the frame 26 to the door. In one example, the front mount 27 can be arranged perpendicular to the side leg 26*a*, and may be secured to the interior face of the door 156 with suitable fasteners, such as screws or bolts. Thus, when the user pulls upon the handle 158 of the VCZ door 156, the frame 26 will be drawn outwards via the slide assembly 28.

Figure 5C:
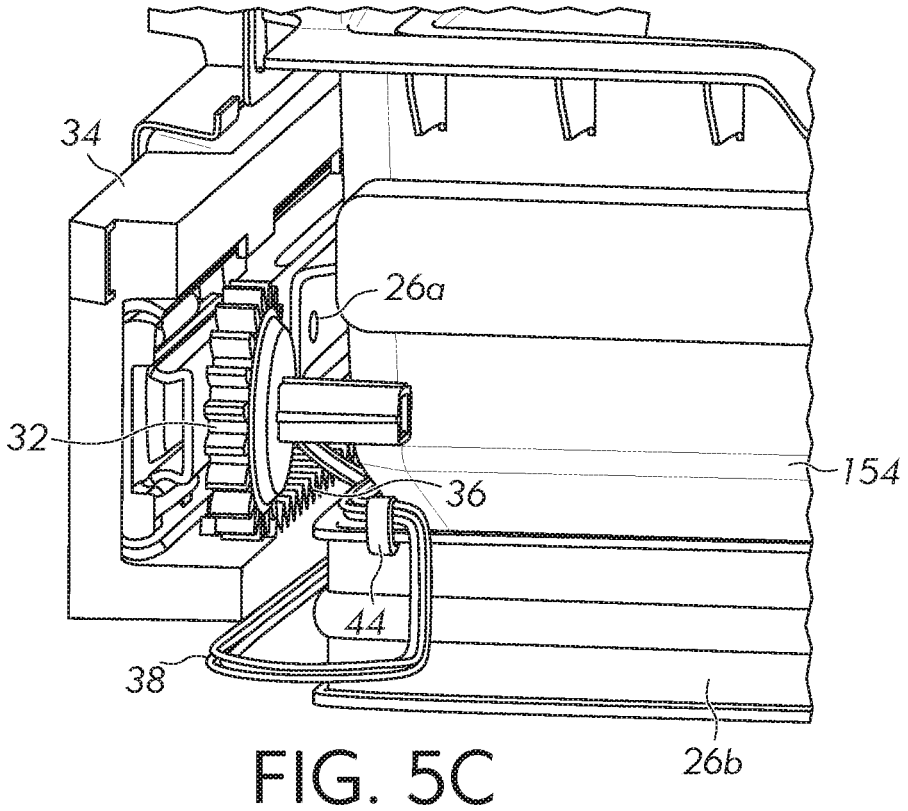
FIG. 5C is an enlarged rear view of the adjustable temperature drawer assembly, according to an embodiment.

FIG. 5C is an enlarged view of the rear side of the drawer assembly 152. A frame member 34, having a plurality of gear teeth 36 forming the linear gear tracks for engaging the timing bar pinion gears 32, is attached to an inner side wall of the liner 72 (not shown in FIG. 5C). As discussed above, electrical power to, and data communication between, the drawer assembly 152 (in particular, the user interface 162 provided on an upper portion of the door 156 of the drawer assembly 152) and a main power/control board (not shown) of the refrigerator is provided via at least one electric wire cable 38, which optionally may be a bundle of cables. Thus, the electric wire cable 38 can provide electrical power and/or data communication directly to the user interface 162 of the VCZ compartment 150. Referring to FIG. 5C, the electric wire cable 38 passes through a space formed between the basket or tray 154 and the side leg 26*a* of the frame 26. Preferably, the electric wire cable 38 is secured to the frame 26 of the drawer assembly 152, such as to the connecting bar 26*b*, via ties or straps 44 or similar mounting structure. In this way, the electric wire cable 38 is moveable within the VCZ compartment 150 together with the frame 26. Additionally, the wall of the side leg 26*a* provides a protective separating boundary between the electric wire cable 38 and the slide assembly 28 and linear gear tracks.

Figure 6:
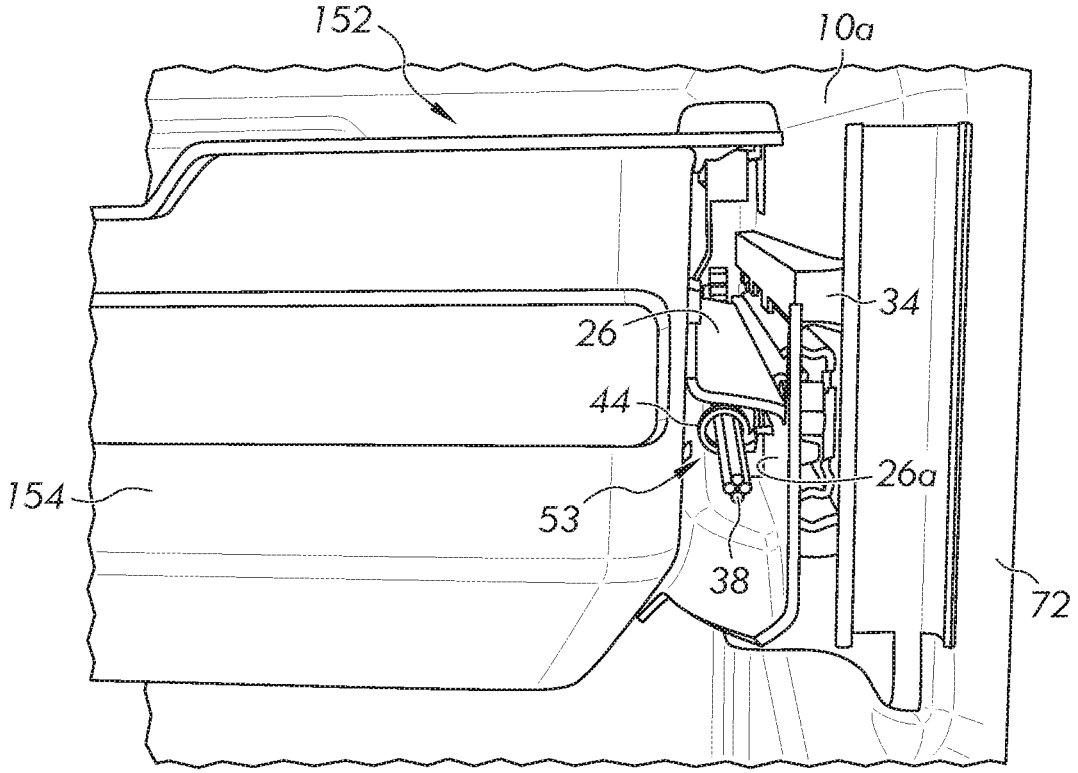
FIG. 6 is an enlarged front view of the adjustable temperature drawer assembly with the door removed for clarity, according to an embodiment.

FIG. 6 shows a front view of the drawer assembly 152 with the door 156 removed for clarity. As shown in FIG. 6, the electric wire cable 38 passes through a space formed between the basket or tray 154 and one of the opposite side legs 26*a* of the frame 26. As shown in FIG. 6, the electric wire cable 38 is pulled through the space 53 formed between the basket or tray 154 and the opposite side leg 26*a* of the frame 26. As shown in FIG. 6, the electric wire cable 38 is preferably secured to the part of the frame 26 of the drawer assembly 152, such as to the side leg 26*a*, for example, via ties or straps 44 or similar mounting structure. This mounting configuration allows the electric wire cable 38 to move within the VCZ compartment 150 together with the frame 26.

Figure 7:
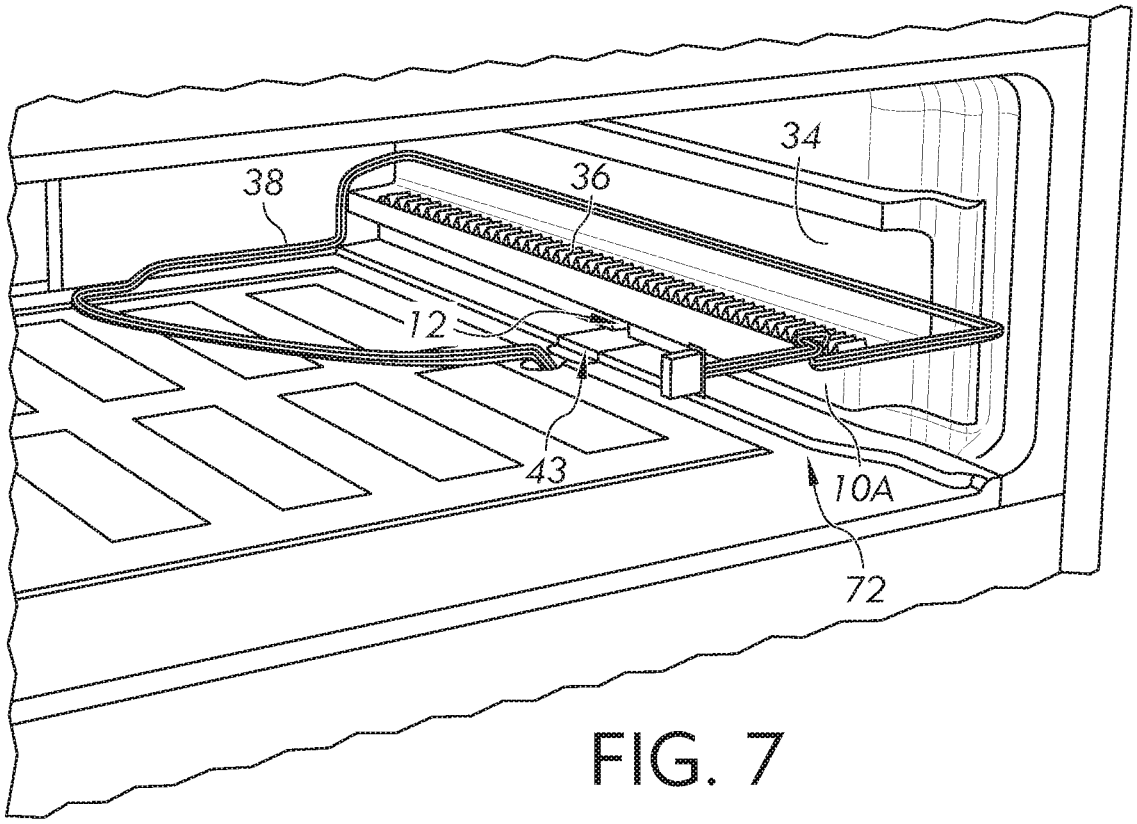
FIG. 7 is a perspective view of a frame for supporting the adjustable temperature drawer assembly mounted to an inner surface of a side wall of the liner and showing the routing of electric wire cable of the adjustable temperature drawer assembly, according to an embodiment.
Figure 8:
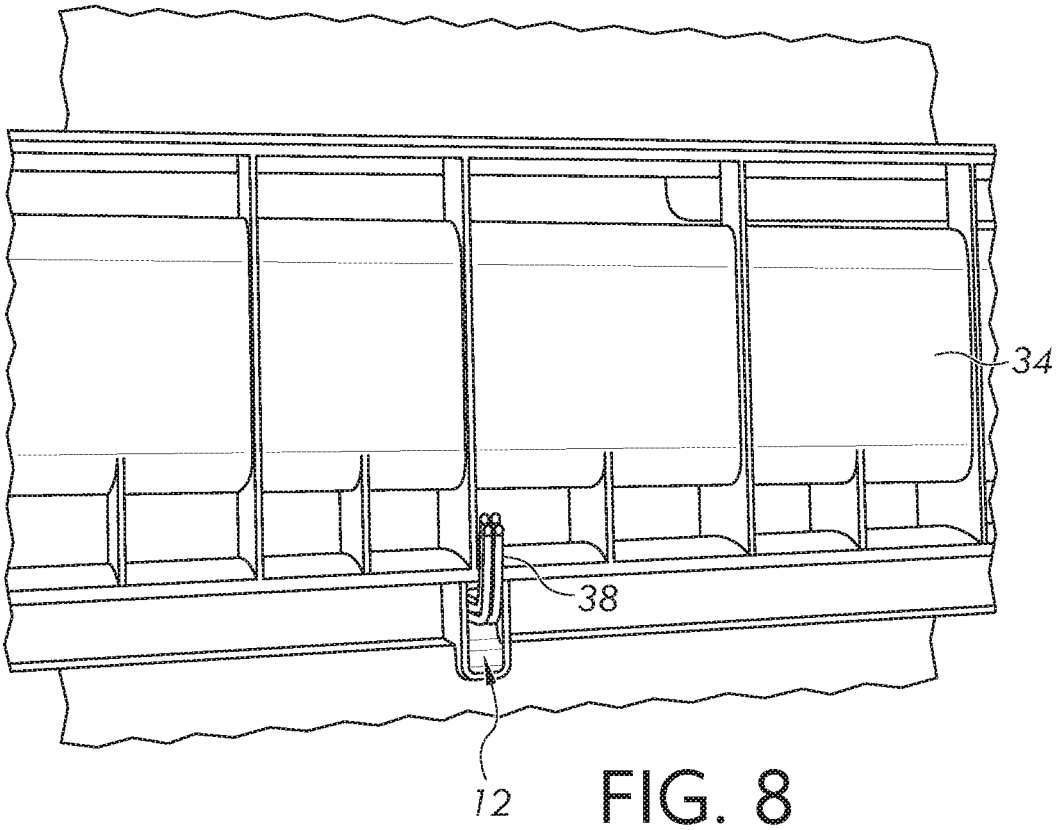
FIG. 8 is a reverse perspective view of the frame for supporting the adjustable temperature drawer assembly showing a slot for accommodating the electric wire cable of the adjustable temperature drawer assembly, according to an embodiment.

FIG. 7 shows the frame member 34 mounted to the inner surface of the side wall 10*a* of the liner 72. The electric wire cable 38 enters the VCZ compartment 150 through a slot 12 formed in the liner 72. Preferably, as shown in FIG. 8, the slot 12 comprises a through hole extending completely through the side wall 10*a* of the liner 72. A portion of the electric wire cable 38 between the ties or straps 44 (shown in FIG. 5C) and the slot 12 in the side wall 10*a* of the VCZ compartment 150 is free to move, without restraint, as the drawer assembly 152 is inserted into and removed from the VCZ compartment 150. Optionally, a portion of the electric wire cable 38 is restrained under a removable floor cover 43 which covers and/or conceals a recessed pocket 42 (shown in FIG. 4A) formed in the partition 90, as the electric wire cable 38 enters the VCZ compartment 150. The recessed pocket 42 is in communication with the slot 12 in the side wall 10*a* of the VCZ compartment 150, so that the electric wire cable 38 may proceed directly into the pocket 42 prior to emerging later into the VCZ compartment. Preferably, the floor cover 43 is removably secured by mechanical fasteners, such as screws, bolts, clips, etc. to facilitate manufacturing and service. In this way, the electric wire cable 38 is protected from the moving/sliding elements of the VCZ drawer during extension and retraction.

The frame member 34 is positioned above the slot 12 such that no portion of the frame member 34 covers the slot 12. FIG. 8 further illustrates this configuration of the interface between the frame member 34 and the side wall of the liner 72 by showing a reverse view looking from an exterior point of view. For clarity of description, the liner 72 is illustrated here as a translucent part through which the frame member 34 is visible; however, in practice the liner 72 is likely to be opaque. In this respect, no portion of the frame member 34 receives or accommodates the electric wire cable 38.

Figure 9:
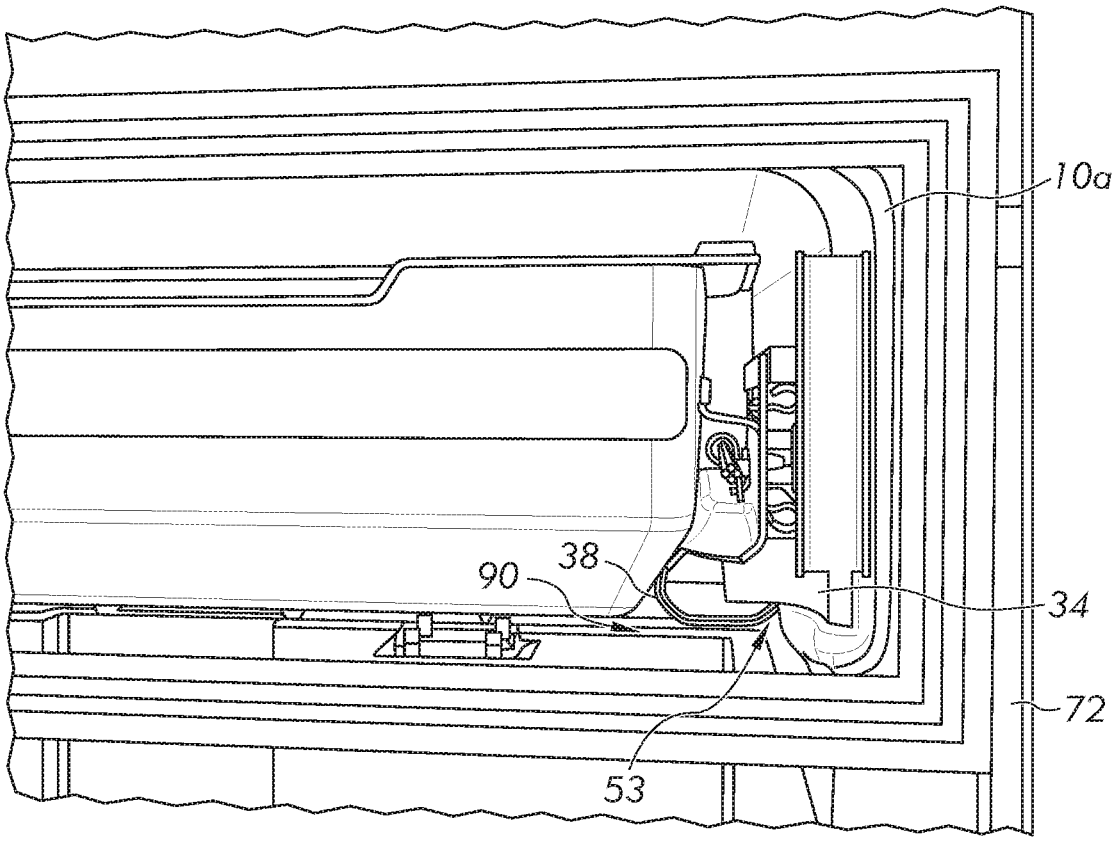
FIG. 9 is a front view of the adjustable temperature drawer assembly showing the electric wire cable of the adjustable temperature drawer assembly extending below the frame for supporting the adjustable temperature drawer assembly, according to an embodiment.

Referring to FIG. 9, the electric wire cable 38 exiting the slot 12 extends into an open space 53 bounded by a lower surface of the frame member 34, an upper surface of the partition 90 (shown in FIG. 3A) between the drawer assembly 152 and the freezer compartment 100, the exterior bottom surface of the basket or tray 154, and the side wall 10*a* (shown in FIG. 7). Optionally, as shown in FIG. 7, a portion of the electric wire cable 38 is restrained under the removable floor cover 43 that covers the pocket 42 (shown in FIG. 4A) formed in the partition 90, as the electric wire cable 38 enters the VCZ compartment 150; the electric wire cable 38 then extends into the open space 53 from a hole in the floor cover 43. Thus, as the drawer assembly 152 is moved between the extended and retracted positions, the electric wire cable 38 is free to flex and move beneath the basket or tray 154 and within the open space 53. The entry point of the electric wire cable 38 into the VCZ compartment 150, such as at the slot 12 in the liner wall, acts as a pivot point from which the electric wire cable 38 flexes. Optionally, where the electric wire cable 38 is restrained under the removable cover 43 (shown in FIG. 7), the pivot point can be at the location from which the electric wire cable 38 exits via a hole from under the removable floor cover 43. If the electric wire cable 38 is secured to the frame 26 of the drawer assembly 152 (e.g., by ties or straps 44 or the like), then the portion of the electric wire cable 38 extending between the liner wall (or bottom cover) and the frame is able to flex and move beneath the basket or tray 154.

Figure 10:
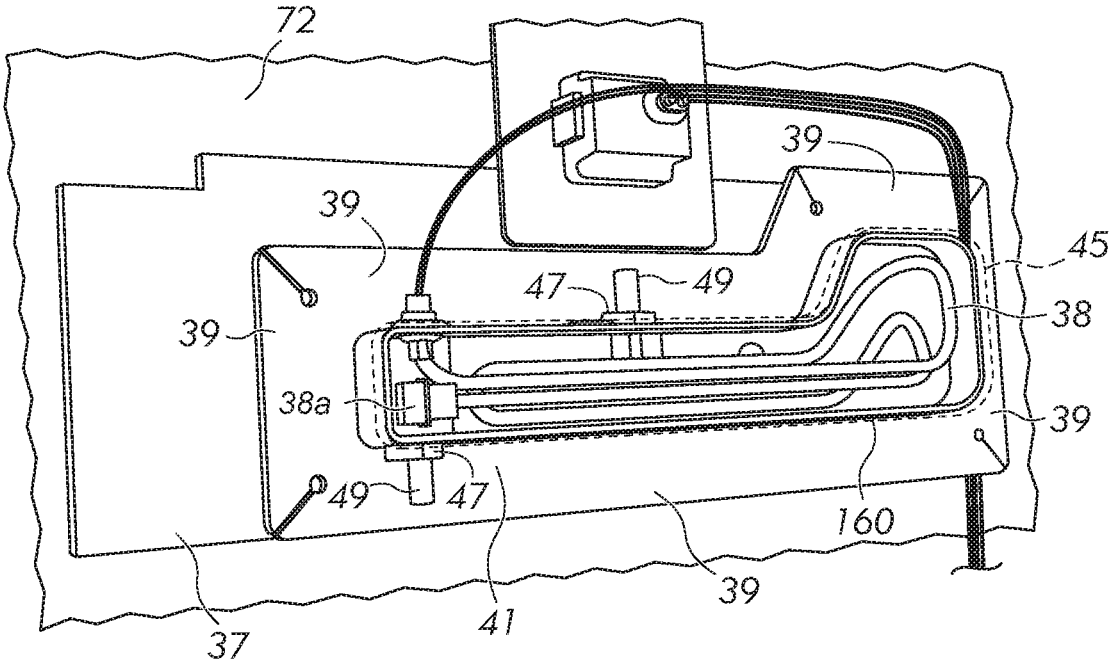
FIG. 10 is an exterior perspective view of an enclosure attached to an outer surface of the liner that houses the electric wire cable of the adjustable temperature drawer assembly, according to an embodiment.

Referring to FIG. 10, prior to foaming the liner 72 (i.e., prior to the injection of insulating foam between the outer metal shell and inner liner 72 of the refrigerator), the portion of the electric wire cable 38 that penetrates into the VCZ compartment 150, including a connector 38*a* provided on one end of the electric wire cable 38, is placed in an enclosure 160 attached to an outer surface of the liner 72 (the liner 72 is partially shown in FIG. 10). A metal enforcement 37 may be applied on the external surface of the liner 72 at a location that corresponds to the recess on the opposite, interior side of the liner 72 receiving the guide rails of the slide assembly 28. A "V"-shaped locating notch 47 is formed at an upper and optionally lower portion of the enclosure 160. Each notch 47 aligns with a corresponding locating stud 49 formed on either or on both of the metal enforcement 37 and the exterior of the liner 72. The enclosure 160 is placed in a position aligning with the slot 12 through the liner 72 using flexible, projecting tabs 39 formed as part of an adhesive sheet 41 (shown in FIG. 10 with the projecting tabs 39 in an extended configuration). After the enclosure 160 is placed in a position, the projecting tabs 39 of the adhesive sheet 41 are folded around the corresponding surfaces of the liner 72 to tightly adhere the enclosure 160 to the liner 72 profile, seal the enclosure 160 against foam entry, and to secure the electric wire cable 38 therein. The adhesive sheet may cover the stud(s) 49, or the studs may project through the sheet. In an alternative embodiment the enclosure 160 is a single piece construction with the line 72 by injection molding. The interior of the enclosure 160 is in fluid communication with the interior of the VCZ compartment 150 via the slot 12 through the liner 72. Optionally, a form-fitting cover plate 45 (shown with dashed lines in FIG. 10) may be installed in a covering relationship to seal the exterior main opening of the enclosure 160 against foam entry and to secure the electric wire cable 38 therein, although the cover of the enclosure 160 is removed for clarity in FIG. 10. The electric wire cable 38 is temporarily housed in the enclosure 160 during manufacturing of the drawer assembly 152. Optionally, a temporary plug can be used to seal the slot 12 so that no foam penetrates into the VCZ compartment 150. After the insulation foaming injection operation is completed, the electric wire cable 38 is pulled out of the enclosure 160 and into the interior of the VCZ compartment 150 via the slot 12. The electric wire cable 38 is routed into the interior of the VCZ compartment 150 along the pathway discussed above. Specifically, as shown in FIGS. 7-8, the electric wire cable 38 enters the VCZ compartment via the slot 12 in the liner side wall and optionally proceeds first under the removable floor cover 43 that covers the pocket 42. As shown in FIG. 5C, the electric wire cable 38 is then routed towards the rear of the compartment along the partition 90 and is preferably secured to the frame 26 of the drawer assembly 152, such as to the connecting bar 26*b*, for example, via ties or straps 44 or similar mounting structure. This mounting configuration allows the electric wire cable 38 to move within the VCZ compartment 150 together with the frame 26. Next, as shown in FIGS. 5C and 9, the electric wire cable 38 is then routed forwardly and pulled through the space 53 formed between the basket or tray 154 and the opposite side leg 26*a* of the frame 26. In addition, a portion of the electric wire cable 38 can be secured to the side leg 26*a* with the ties or straps 44 (shown in FIG. 5C), preferably towards a middle or front side of the basket or tray 154. The connector 38*a* provided on one end of the electric wire cable 38 is configured for removable connection to a mating connector (see FIG. 11) on the rear surface of the door 156 of the drawer assembly 152 to provide electrical communication with the user interface 162 provided on the door 156 of the drawer assembly 152.

As partially shown in FIG. 10, the opposite end of the electric wire cable 38 passes through a sealing plug/grommet in one sidewall of the enclosure 160 and is directly connected to the main power/control board (not shown in FIG. 10) of the refrigerator. The drawer assembly 152 does not include a connector at the side wall 10*a* of the liner 72.

Figure 11:
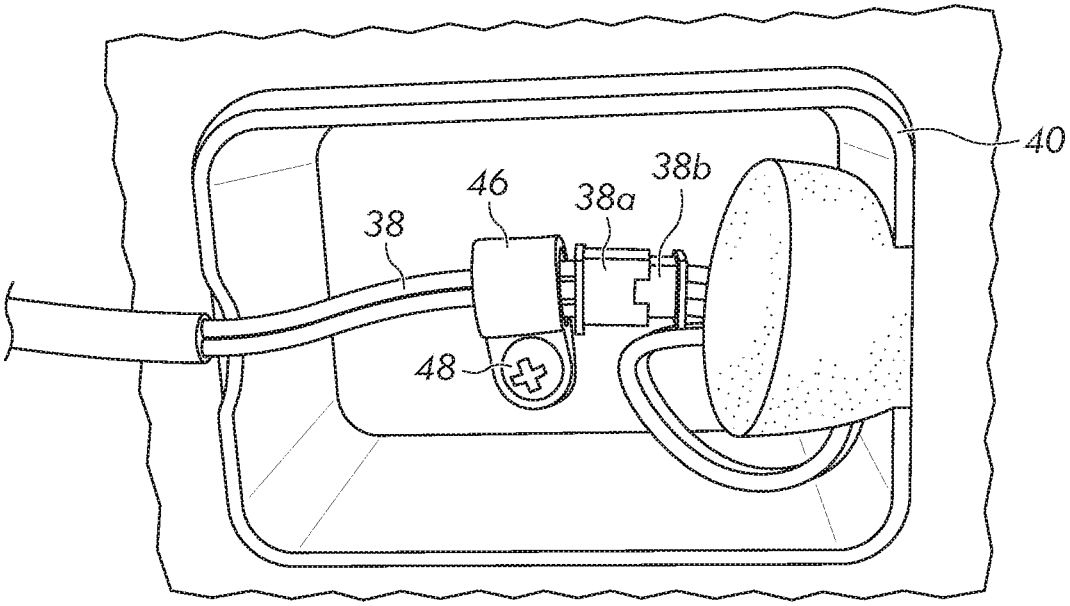
FIG. 11 is a perspective view of an open box provided on the interior side of the door of the drawer for the variable climate zone compartment, securing the connector of the electric wire cable of the adjustable temperature drawer assembly, according to an embodiment.

Referring to FIGS. 5B and 11, the connector 38*a* of the electric wire cable 38 is placed inside an open box 40 mounted on an inner side of the VCZ door 156. No cover plate or a locking plate of any kind is intended to be provided to close or cover the open box 40. Within the open box 40, the connector 38*a* is matingly connected to the connector 38*b* of the user interface 162 so that user input to change the temperature of the VCZ compartment 150 are communicated to the main power/control board (not shown) of the refrigerator 50. As shown in FIG. 11, the connector 38*a* is secured in a position by a suitable locking member, such as a "C" clamp 46 that is secured to the open box 40 by a screw 48. Alternatively, a wall with a "V" channel or the like may project outwards from the interior of the open box 40, with the electric wire cable 38 passing through the "V" while the connector 38*a* is prevented from passing. In this manner, the electrical connector 38*a* cannot be accidentally separated from its mating connector 38*b*, which is provided on the user interface 162 in the door 156 of the drawer assembly 152.

As illustrated in FIGS. 5A-5C and 6-9, the electric wire cable 38 is free to bend within the drawer assembly 152 and the freezer compartment 100. In particular, the drawer assembly 152 does not include a structure, element or component that controls the movement of the electric wire cable 38, or that maintains the electric wire cable 38 in a curved state while the drawer assembly 152 moves between the retracted position and the extended position.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

The invention claimed is:

1. A refrigeration appliance comprising:

a main electrical board configured to control operation of the refrigeration appliance;

a fresh food compartment for storing food items at a first target temperature above zero degrees Centigrade;

a freezer compartment for storing food items at a second target temperature below zero degrees Centigrade; and an adjustable temperature compartment for storing food items at a user-selectable target temperature, the adjustable temperature compartment comprising:

a user interface connected to the main electrical board by an electric wire cable and configured to enable selection of said user-selectable target temperature;

a door closing the adjustable temperature compartment from the exterior environment;

a support structure attached to a wall within the adjustable temperature compartment; and a storage bin supported by the support structure and movable with respect to the support structure, the storage bin having a frame supporting the storage bin, wherein a first end of the electric wire cable includes a removable connector connected to the user interface and wherein the second end of the electric wire cable is directly connected to the main electrical board.

2. The refrigeration appliance according to claim 1, wherein the user interface is provided at a surface of the adjustable temperature compartment that is not visible when the adjustable temperature compartment is in a closed position.

3. The refrigeration appliance according to claim 1, wherein the user interface is provided on an upper portion of the door of the adjustable temperature compartment.

4. The refrigeration appliance according to claim 1, wherein the user interface is accessible when the door of the adjustable temperature compartment is extended from the refrigeration appliance.

5. The refrigeration appliance according to claim 1, wherein the electric wire cable is secured to the frame of the storage bin via ties or straps.

6. The refrigeration appliance according to claim 1, wherein the adjustable temperature compartment is arranged between the fresh food compartment and the freezer compartment.

7. The refrigeration appliance according to claim 5, further comprising a liner that defines the fresh food compartment, the freezer compartment, and the adjustable temperature compartment, and a slot formed through a side wall of the liner, wherein the electric wire cable enters the adjustable temperature compartment through the slot.

8. The refrigeration appliance according to claim 7, wherein a portion of the electric wire cable between the ties or straps and the slot is free to move, without restraint, when the storage bin is inserted into and removed from the adjustable temperature compartment.

9. The refrigeration appliance according to claim 7, wherein the support structure comprises a frame mounted to an inner surface of the side wall of the liner, the frame being positioned above the slot such that no portion of the frame covers the slot.

10. The refrigeration appliance according to claim 7, further comprising a removable partition separating the adjustable temperature compartment and the freezer compartment, wherein a portion of the electric wire cable exiting the slot extends in an open space bounded by a lower surface of the frame, an upper surface of the removable partition, and the side wall.

11. The refrigeration appliance according to claim 10, wherein the removable partition comprises a recessed pocket in communication with the slot and that is concealed by a removable cover, and wherein a portion of the electric wire cable is seated underneath the removable cover.

12. The refrigeration appliance according to claim 1, wherein the frame comprises opposite side legs and a connecting bar, and wherein the electric wire cable passes through a space formed between the storage bin and one of the opposite side legs of the frame.

13. The refrigeration appliance according to claim 1, wherein the frame comprises a slide assembly with timing bar pinion gears attached to both sides of the frame and a plurality of gear teeth forming linear gear tracks for engaging the timing bar pinion gears, and wherein the electric wire cable passes through a space formed between the storage bin and the plurality of gear teeth.

14. The refrigeration appliance according to claim 7, wherein the liner comprises an enclosure in fluid communication with the slot, the enclosure being arranged between the liner and an outer shell of the refrigerator, wherein the enclosure defines a space to receive at least a portion of electric wire cable and the enclosure is configured to avoid entry of foam during an insulation foaming injection operation to inject foam between the liner and an outer shell of the refrigerator.

15. The refrigeration appliance according to claim 14, wherein the enclosure compromises a cover installed in a covering relationship to seal an exterior main opening of the enclosure against foam entry and to secure the electric wire cable therein.

* * * * *